US006786332B1

(12) United States Patent
Patrick et al.

(10) Patent No.: US 6,786,332 B1
(45) Date of Patent: Sep. 7, 2004

(54) PROTECTIVE HOLDER FOR A REMOTE CONTROL

(76) Inventors: Ralph J. Patrick, 36 Bambi La., Haverford, PA (US) 19041; Marva E. Patrick, 36 Bambi La., Haverford, PA (US) 19041

( * ) Notice: Subject to any disclaimer, the term of this patent is extended or adjusted under 35 U.S.C. 154(b) by 291 days.

(21) Appl. No.: 10/074,471

(22) Filed: Feb. 12, 2002

(51) Int. Cl.[7] ..... B65D 85/38

(52) U.S. Cl. ..... 206/305; 206/37.1; 220/326; 220/830

(58) Field of Search ..... 206/305, 320, 206/37, 37.1, 38, 38.1, 39; 220/212, 324, 326, 829, 830

(56) References Cited

U.S. PATENT DOCUMENTS 4,483,355 A * 11/1984 Yuhara ..... 220/23.4
4,768,648 A * 9/1988 Glass ..... 206/305
4,799,604 A * 1/1989 Okojima et al. ..... 220/830
5,220,319 A * 6/1993 Kendel ..... 206/37.1
5,388,691 A * 2/1995 White ..... 206/305
5,560,476 A * 10/1996 Lee ..... 206/38
5,904,898 A * 5/1999 Markart ..... 206/305
6,286,667 B1 * 9/2001 Lee ..... 206/305

* cited by examiner

*Primary Examiner*—Luan K. Bui

(57) ABSTRACT

A protective holder for a remote control for use in connection with a keyless entry remote control. A lid is secured by a latching mechanism to a controller holder, and a means for attaching a key ring is also present. The protective holder prevents inadvertent depression of buttons on such remote controls when the remote control is stored in a pocket or purse. The protective holder also prevents damage to the remote control if the remote control is dropped or brought into contact with other objects.

3 Claims, 5 Drawing Sheets

PROTECTIVE HOLDER FOR A REMOTE CONTROL

BACKGROUND OF THE INVENTION

1. Field of the Invention

The present invention relates to a protective holder for a remote control for use in connection with a keyless entry remote control. The protective holder for a remote control has particular utility in connection with preventing the inadvertent depression of buttons on such remotes when the remote is stored in a pocket or purse. This, in turn, prevents the device the remote acts upon from being accidentally unlocked. Also, the protective holder will prevent the remote control from being damaged if it is dropped or other objects come into contact with it.

2. Description of the Prior Art

Protective holders for a remote control are desirable for preventing the inadvertent activation of buttons on the remote control contained within. For example, a vehicle with a keyless entry remote control could not be accidentally unlocked, thereby enhancing security. Also, the protective holder will protect the remote control from damage in the event it is dropped or other objects come into contact with it.

The use of protective devices and controller holders are known in the prior art. For example, U.S. Pat. No. 6,155,416 to Martin Jaime discloses a remote car alarm protective device. However, the Martin Jaime U.S. Pat. No. 6,155,416 patent does not fully enclose the remote control, thereby leaving the lower portion of the remote vulnerable to damage, and has further drawbacks of not providing a means for attaching a key ring or securely latching the lid to ensure that it does not open unintentionally.

U.S. Pat. No. 5,850,754 to Kirk G. Dobbins discloses a car alarm controller holder system that prevents a car alarm controller from becoming dirty. However, the Kirk G. Dobbins U.S. Pat. No. 5,850,754 patent does not prevent the inadvertent activation of buttons on the controller, and additionally does not provide a means for protecting the controller's keypad from damage from sharp, pointed objects since a flexible controller access cover made of vinyl is employed as a substantial portion of the controller enclosure.

Similarly, U.S. Pat. No. 5,769,212 to La Vella Collins discloses an automotive alarm system remote control keypad pouch that allows for association of a key ring with an automotive alarm system remote control keypad in the event the keypad cannot accept a key ring as a result of a design limitation or structural failure. However, the La Vella Collins U.S. Pat. No. 5,769,212 patent does not provide a means for simultaneously viewing and activating the keypad without removing the keypad from the pouch, and can not prevent the inadvertent activation of the keypad.

Furthermore, U.S. Pat. No. 4,805,820 to Thomas G. Kearney et al discloses a portable receptacle that is useful for carrying prophylactic packages. However, the Thomas G. Kearney et al U.S. Pat. No. 4,805,820 patent does not provide a means to enclose a remote control.

In addition, U.S. Pat. No. Des. 427,926 to Cozart Lowery discloses the ornamental design for a remote keyless entry and cover. The Cozart Lowery U.S. Pat. No. Des. 427,926 patent does not have a latching mechanism to secure the lid to prevent inadvertent opening, and it also lacks a means for attaching a key ring.

Moreover, U.S. Pat. No. 5,388,691 to Nona J. White discloses a protective case for remote control transmitter that encloses a remote control transmitter and provides a means for attaching a key ring. However, the Nona J. White U.S. Pat. No. 5,388,691 patent has an unattached lid, which renders the lid vulnerable to loss.

Lastly, U.S. Pat. No. 4,762,227 to Robert C. Patterson discloses a resilient housing for remote controllers that encloses a remote controller. However, the Robert C. Patterson U.S. Pat. No. 4,762,227 patent does not prevent the inadvertent activation of the controller's buttons, and has the additional deficiency of not providing a means for attaching a key ring.

While the above-described devices fulfill their respective, particular objectives and requirements, the aforementioned patents do not describe a protective holder for a remote control that prevents the inadvertent depression of buttons on such remotes when the remote is stored in a pocket or purse. The Martin Jaime U.S. Pat. No. 6,155,416 patent does not protect the lower portion of the remote from damage, has no provision for attaching a key ring, and does not provide a lid latching mechanism. The Kirk G. Dobbins U.S. Pat. No. 5,850,754 patent does not prevent inadvertent depression of buttons on the enclosed controller and does not provide protection from sharp, pointed objects for the enclosed controller's keypad. The La Vella Collins U.S. Pat. No. 5,769,212 patent does not allow the keypad to be viewed during activation unless the keypad is removed from the pouch and does not prevent inadvertent activation of the keypad. The Thomas G. Kearney U.S. Pat. No. 4,805,820 patent does not provide a means for enclosing a remote control. The Cozart Lowery U.S. Pat. No. Des. 427,926 patent lacks a lid latching mechanism and a means for attaching a key ring. The Nona J. White U.S. Pat. No. 5,388,691 patent does not have an attached lid. The Robert C. Patterson U.S. Pat. No. 4,762,227 patent does not prevent inadvertent activation of the enclosed controller's buttons, and furthermore, lacks means for attaching a key ring.

Therefore, a need exists for a new and improved protective holder for a remote control that can be used for preventing the inadvertent depression of buttons on such remotes when the remote is stored in a pocket or purse. In this regard, the present invention substantially fulfills this need. In this respect, the protective holder for a remote control according to the present invention substantially departs from the conventional concepts and designs of the prior art, and in doing so provides an apparatus primarily developed for the purpose of preventing the inadvertent depression of buttons on such remotes when the remote is stored in a pocket or purse.

SUMMARY OF THE INVENTION

In view of the foregoing disadvantages inherent in the known types of protective devices and controller holders now present in the prior art, the present invention provides an improved protective holder for a remote control, and overcomes the above-mentioned disadvantages and drawbacks of the prior art. As such, the general purpose of the present invention, which will be described subsequently in greater detail, is to provide a new and improved protective holder for a remote control to prevent inadvertent activation of buttons on the remote control contained within which has all the advantages of the prior art mentioned heretofore and many novel features that result in a protective holder for a remote control which is not anticipated, rendered obvious, suggested, or even implied by the prior art, either alone or in any combination thereof.

To attain this, the present invention essentially comprises a protective holder for a remote control having a controller holder to enclose the remote control, and a hinged lid to cover the remote control and prevent activation of the remote control's buttons when it is not desired.

There has thus been outlined, rather broadly, the more important features of the invention in order that the detailed description thereof that follows may be better understood and in order that the present contribution to the art may be better appreciated.

The invention may also include a latching mechanism to ensure that the lid remains closed when the controller is not in use. There may also be a means for attaching a key ring to the invention. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved protective holder for a remote control that has all of the advantages of the prior art protective devices and controller holders and none of the disadvantages.

It is another object of the present invention to provide a new and improved protective holder for a remote control that may be easily and efficiently manufactured and marketed.

An even further object of the present invention is to provide a new and improved protective holder for a remote control that has a low cost of manufacture with regard to both materials and labor, and which accordingly is then susceptible of low prices of sale to the consuming public, thereby making such protective holder for a remote control economically available to the buying public.

Still another object of the present invention is to provide a new protective holder for a remote control that provides in the apparatuses and methods of the prior art some of the advantages thereof, while simultaneously overcoming some of the disadvantages normally associated therewith.

Even still another object of the present invention is to provide a protective holder for a remote control for preventing the inadvertent depression of buttons on such remotes when the remote is stored in a pocket or purse. This allows the user to be confident that the remote will not be activated inadvertently, thereby ensuring that the device operated by the remote is not acted upon accidentally.

Still yet another object of the present invention is to provide a protective holder for a remote control for protecting the remote from damage. This makes it possible to drop or have the remote control come into contact with other objects without suffering damage.

Yet another object of the present invention is to provide a protective holder for a remote control for associating a key ring with the remote. This enables the user to have convenient access to their keys and an additional means of gripping the remote control even if the remote control does not have a key ring attachment means.

An additional object of the present invention is to provide a protective holder for a remote control for preventing loss of any of the components of the protective holder. This ensures that the user does not have to be concerned about misplacing any parts of the protective holder that would impair the function of the protective holder.

Lastly, it is an object of the present invention to provide a new and improved protective holder for a remote control for use in preventing damage to, and inadvertent activation of buttons on, such a remote.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
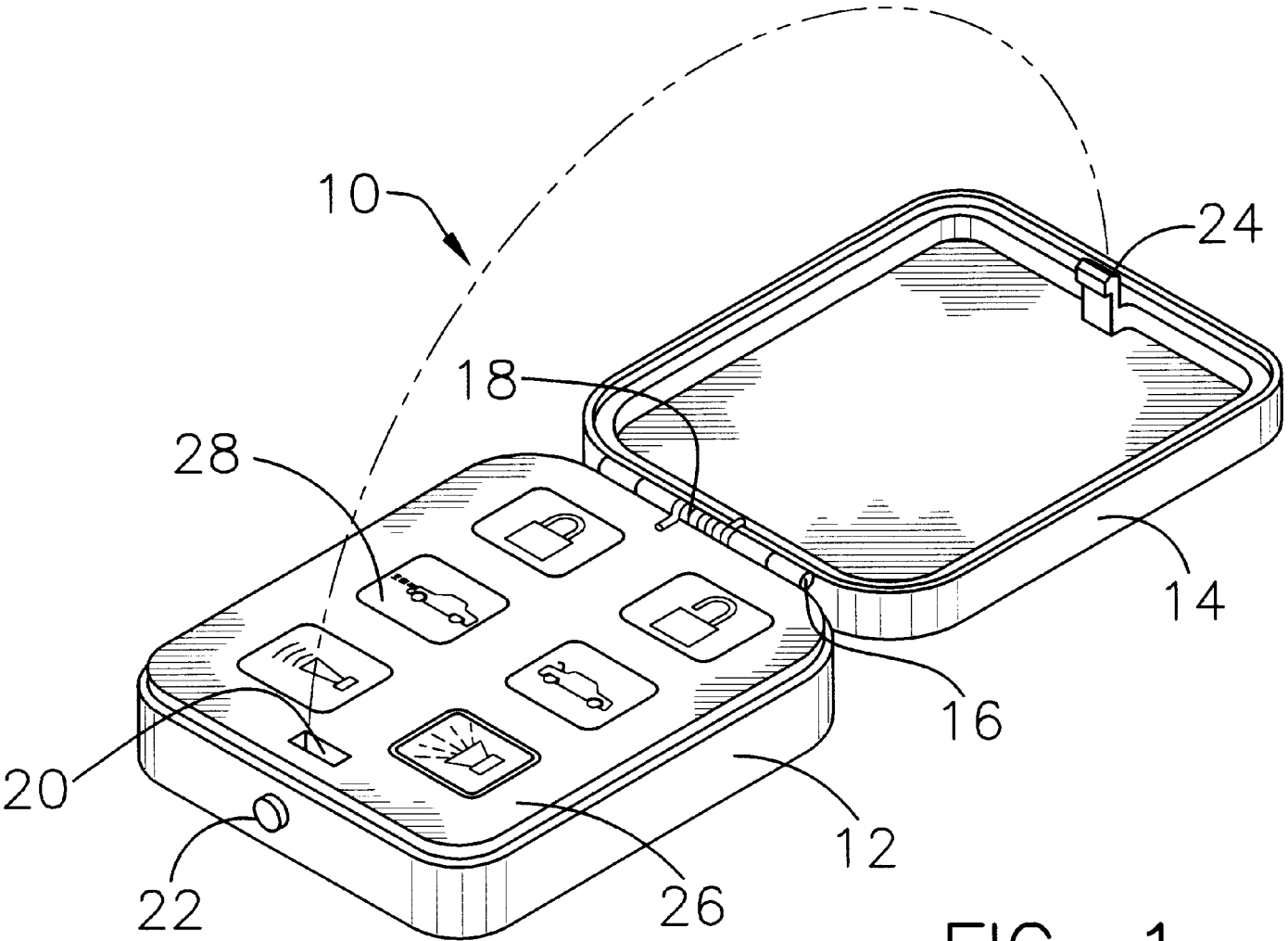
FIG. 1 is a top perspective view of the current embodiment of the protective holder for a remote control constructed in accordance with the principles of the present invention.

Referring now to the drawings, and particularly to FIGS. 1–5, a current embodiment of the protective holder for a remote control of the present invention is shown and generally designated by the reference numeral 10.

In FIG. 1, a new and improved protective holder for a remote control 10 of the present invention for preventing the inadvertent depression of buttons on such remotes is illustrated and will be described. More particularly, the protective holder for a remote control 10 has a controller holder 12 one-half inch high, two and one-half inches long, and one and one-half inches wide with a rectangular or oval shape made from a rigid material such as plastic. Connected to the distal end of controller holder 12 by its proximal end by a hinged coupling 16 is a lid 14 one-quarter inch high, two and one-half inches long, and one and one-half inches wide with a rectangular or oval shape made from a rigid material such as plastic. Wrapped around hinged coupling 16 is spring 18 made from steel. In the proximal end of controller holder 12 is receiving slit 20, which receives locking tongue 24. Locking tongue 24 is attached to the distal end of lid 14. Also attached to controller holder 12 at its proximal end is release button 22. Note that the remote control 26 and buttons 28 are for illustrative purposes only and are not part of the current invention.

Figure 2:
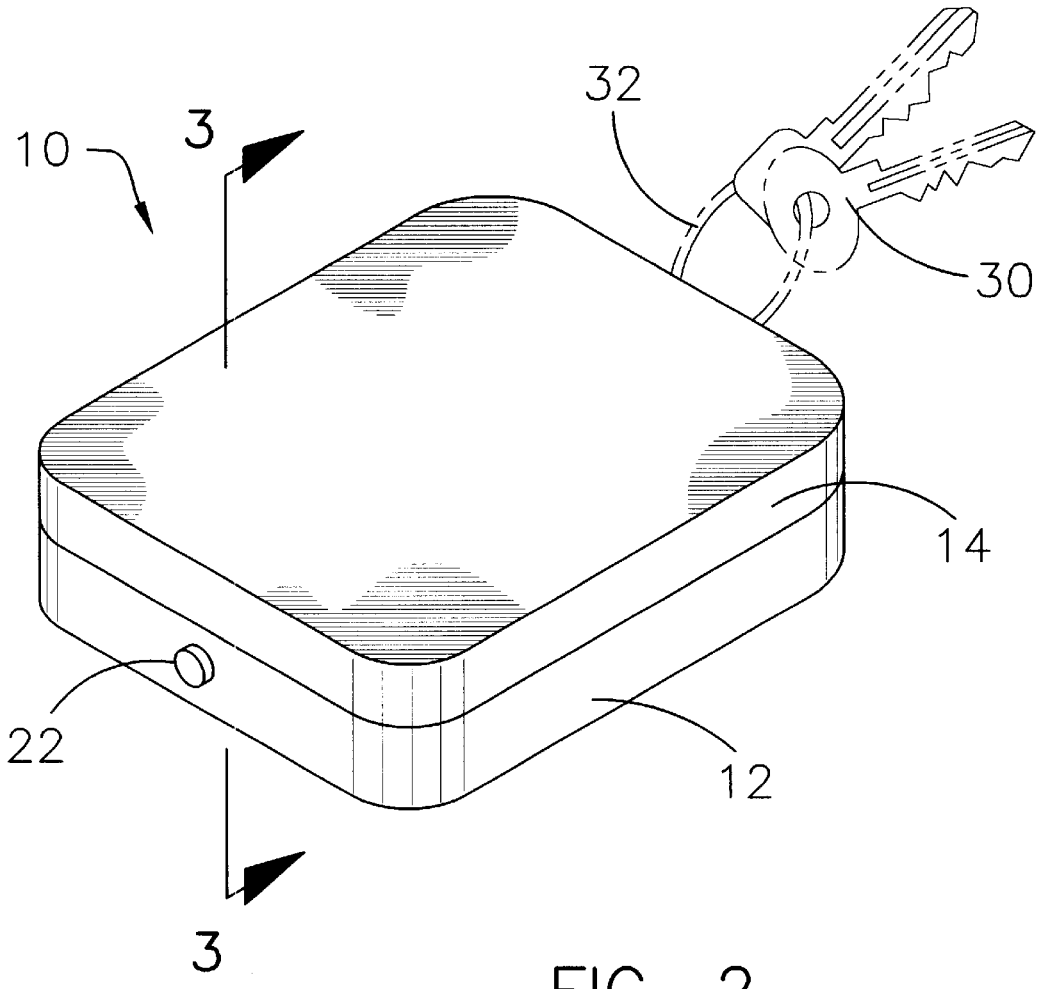
FIG. 2 is a top perspective view of the protective holder for a remote control of the present invention.

Continuing with FIG. 2, an illustration of the current embodiment 10 is illustrated therein. Lid 14 has been closed over controller holder 12. Release button 22, which will allow the lid 14 to disengage from controller holder 12 when depressed with sufficient force, is shown. Note that the key ring 32 and keys 30 are for illustrative purposes only and are not part of the current invention.

Figure 3:
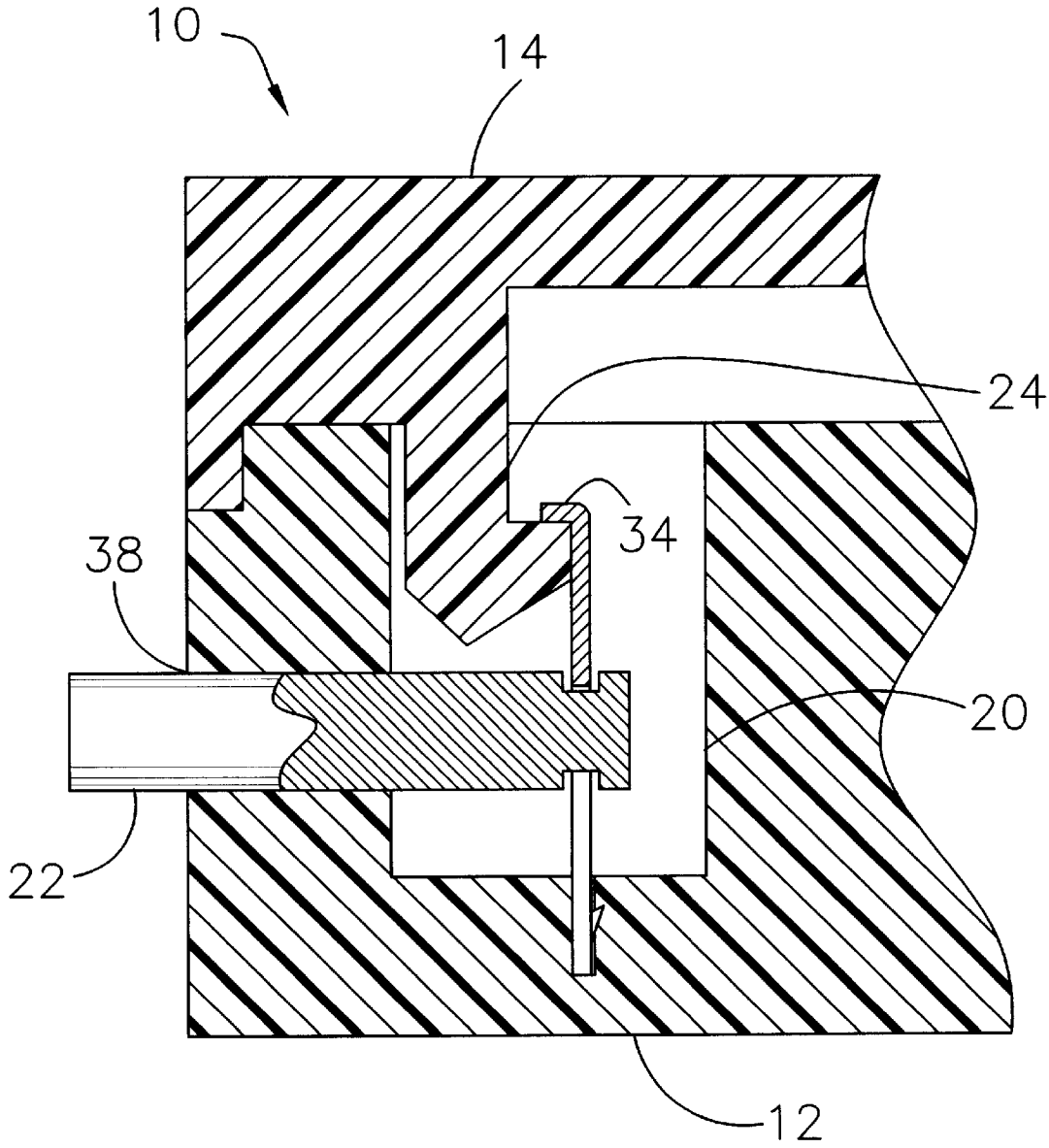
FIG. 3 is a side sectional view of the protective holder for a remote control of the present invention.

Moving on to FIG. 3, an illustration of the current embodiment 10 is illustrated therein. Lid 14 is closed over controller holder 12 by insertion of the locking tongue 24 into receiving slit 20 and is retained by resistive force exerted by catch 34 on locking tongue 24. Release button 22 is shown inserted through release button hole 38, and catch 34 is connected to release button 22 at the distal end of release button 22. Catch 34 is further attached to controller holder 12.

Figure 4:
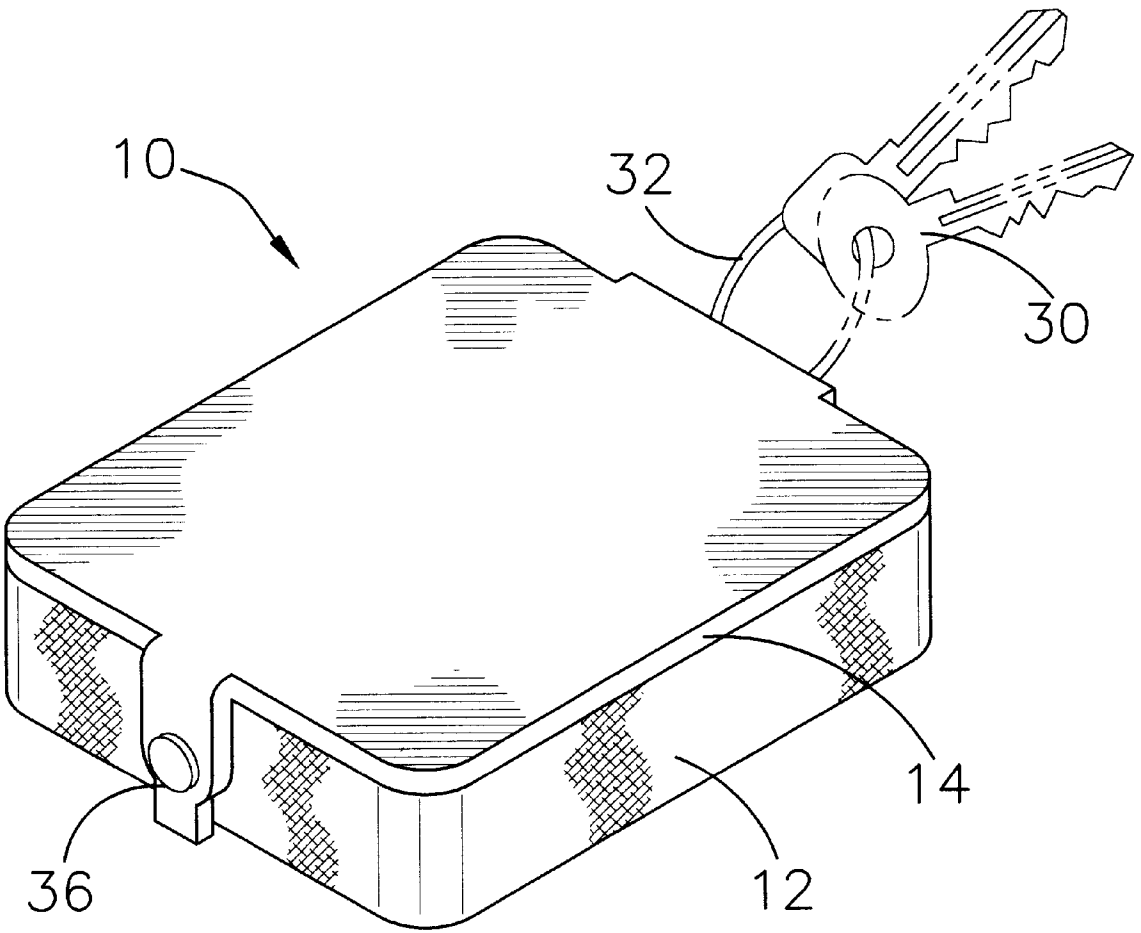
FIG. 4 is a top perspective view of the protective holder for a remote control of the present invention.

Examining FIG. 4, an illustration of the current embodiment 10 is illustrated therein. Lid 14 is closed over controller holder 12 and retained in that position by snap fastener 36. Note that the key ring 32 and keys 30 are for illustrative purposes only and are not part of the current invention.

Figure 5:
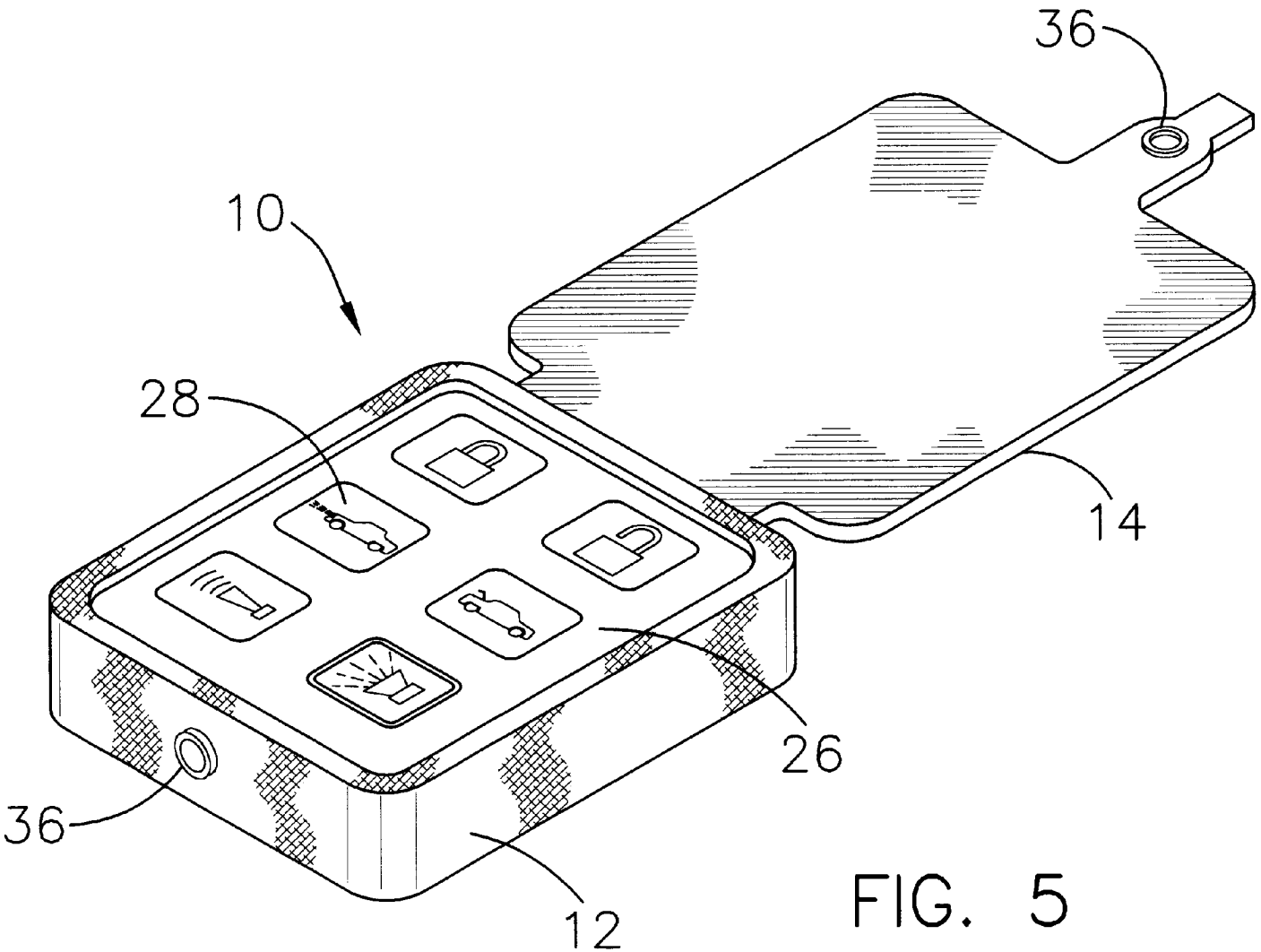
FIG. 5 is a top perspective view of the protective holder for a remote control of the present invention.

Concluding with FIG. 5, an illustration of the current embodiment 10 is illustrated therein. Lid 14 is not covering controller holder 12, revealing remote control 26 with buttons 28. The two components of snap fastener 36 are also visible. Note that the remote control 26 and buttons 28 are for illustrative purposes only and are not part of the current invention.

While a current embodiment of the protective holder for a remote control has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any material resistant to deformation such as steel, aluminum, wood, titanium, or leather may be used instead of the plastic lid and controller holder described. Also, a key ring inserted into a hole in the distal end of the controller holder and the proximal end of the lid could provide a joining and pivoting mechanism replacing the hinged coupling and spring. Furthermore, the release button could have a spring attached to the end of it to provide force to maintain the placement of the catch, thereby eliminating the need for the catch to be attached to the controller holder and deflected in order to receive and release the locking tongue. Finally, the remote control need not be a separate element but could instead be molded directly into the controller holder.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A protective holder for a remote control comprising:

a controller holder having a proximal end, a distal end, and an interior edge and a lid having a proximal end, a distal end, and an interior edge hingedly coupled along said interior edge of said proximal end of said lid to said interior edge of said distal end of said controller holder; and a latching mechanism attached to said proximal end of said controller holder and said distal end of said lid, wherein said latching mechanism comprises:

a receiving slit wherein said proximal end of said controller holder comprises a slit therein to comprise said receiving slit;

a release button hole wherein said proximal end of said controller holder comprises a hole therein to comprise said release button hole;

a release button comprising a rod inserted through said release button hole;

a catch with a base end attached to said release button and said base end of said catch is embedded in said controller holder; and a locking tongue attached to said distal end of said lid.

2. A protective holder for an automobile keyless entry remote control comprising:

a controller holder having a proximal end, a distal end, and an interior edge;

a lid having a proximal end, a distal end, and an interior edge hingedly coupled along said interior edge of said proximal end of said lid to said interior edge of said distal end of said controller holder;

a spring wrapped around said hinged coupling;

a latching mechanism attached to said proximal end of said controller holder and said distal end of said lid;

a receiving slit wherein said proximal end of said controller holder comprises a slit therein to comprise said receiving slit;

a release button hole wherein said proximal end of said controller holder comprises a hole therein to comprise said release button hole;

a release button comprising a rod inserted through said release button hole;

a catch with a base end attached to said release button and said base end of said catch is embedded in said controller holder; and a locking tongue attached to said distal end of said lid.

3. A protective holder for an automobile keyless entry remote control comprising:

a controller holder having a proximal end, a distal end, and an interior edge;

a lid having a proximal end, a distal end, and an interior edge hingedly coupled alone said interior edge of said proximal end of said lid to said interior edge of said distal end of said controller holder;

a spring wrapped around said hinged coupling;

key ring attachment means attached to said distal end of said controller holder; and a latching mechanism attached to said proximal end of said controller holder and said distal end of said lid, wherein said latching mechanism comprises:

a receiving slit wherein said proximal end of said controller holder comprises a slit therein to comprise said receiving slit;

a release button hole wherein said proximal end of said controller holder comprises a hole therein to comprise said release button hole;

a release button comprising a rod inserted through said release button hole;

a catch with a base end attached to said release button and said base end of said catch is embedded in said controller holder; and a locking tongue attached to said distal end of said lid.

* * * * *